US010512386B2

(12) United States Patent
Boyer

(10) Patent No.: US 10,512,386 B2
(45) Date of Patent: Dec. 24, 2019

(54) DISHWASHER APPLIANCE AND FILTER

(71) Applicant: Haier US Appliance Solutions, Inc., Wilmington, DE (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 108 days.

(21) Appl. No.: 15/441,412

(22) Filed: Feb. 24, 2017

(65) Prior Publication Data

US 2018/0242813 A1 Aug. 30, 2018

(51) Int. Cl.

| | |
|---|---|
| ***A47L 15/42*** | (2006.01) |
| ***A47L 15/50*** | (2006.01) |
| ***A47L 15/22*** | (2006.01) |
| ***A47L 15/46*** | (2006.01) |

(52) U.S. Cl.

CPC ..... *A47L 15/4208* (2013.01); *A47L 15/22* (2013.01); *A47L 15/4219* (2013.01); *A47L 15/4259* (2013.01); *A47L 15/4285* (2013.01); *A47L 15/4293* (2013.01); *A47L 15/46* (2013.01); *A47L 15/502* (2013.01); *A47L 15/507* (2013.01)

(58) Field of Classification Search

CPC ..... A47L 15/4208; A47L 15/4259; A47L 15/507; A47L 15/502; A47L 15/46; A47L 15/4285; A47L 15/4219; A47L 15/4293; A47L 15/22

See application file for complete search history.

(56) References Cited

U.S. PATENT DOCUMENTS

| | | | | |
|---|---|---|---|---|
| 4,998,548 | A * | 3/1991 | Lagerstrand | A47L 15/4204 134/111 |
| 6,418,943 | B1 * | 7/2002 | Miller | A47L 15/4202 134/104.1 |
| 8,973,591 | B2 | 3/2015 | Boyer et al. | |
| 2004/0163690 | A1 * | 8/2004 | Kim | A47L 15/4206 134/104.1 |
| 2006/0130878 | A1 * | 6/2006 | Lee | A47L 15/0049 134/18 |

(Continued)

FOREIGN PATENT DOCUMENTS

| | | |
|---|---|---|
| EP | 2999390 A1 | 3/2016 |
| KR | 1645040 B1 | 8/2016 |

(Continued)

*Primary Examiner* — Benjamin L Osterhout

(74) *Attorney, Agent, or Firm* — Dority & Manning, P.A.

(57) ABSTRACT

A dishwasher appliance includes a tub defining a wash chamber with a sump positioned at a bottom of the wash chamber for receiving fluid from the wash chamber. A filtering system is positioned between the wash chamber and an outlet of the sump portion. The filtering system includes a first filter and a second filter. The second filter includes a hollow annular base portion and a filter body extending between the base portion and the first filter. The second filter also includes a plurality of nozzles circumferentially arranged about the hollow annular base portion, each nozzle of the plurality of nozzles in fluid communication with the hollow annular base portion and oriented towards the filter body for cleaning the filter body. An inlet in fluid communication with the hollow annular base portion may also be provided.

16 Claims, 10 Drawing Sheets

(56) References Cited

U.S. PATENT DOCUMENTS

| | | | | |
|---|---|---|---|---|
| 2009/0211600 | A1* | 8/2009 | Steiner | A47L 15/4204 134/10 |
| 2011/0197933 | A1* | 8/2011 | Yoon | A47L 15/4206 134/110 |
| 2012/0097200 | A1* | 4/2012 | Fountain | A47L 15/22 134/56 D |
| 2013/0319477 | A1* | 12/2013 | Lim | A47L 15/4208 134/34 |
| 2014/0305474 | A1* | 10/2014 | Tempelmann | A47L 15/4204 134/110 |
| 2015/0000714 | A1* | 1/2015 | Yoo | A47L 15/22 134/111 |
| 2015/0096599 | A1* | 4/2015 | Tang | A47L 15/4208 134/104.1 |

FOREIGN PATENT DOCUMENTS

| | | | |
|---|---|---|---|
| WO | WO2013164200 | A1 | 11/2013 |
| WO | WO2014102364 | A1 | 7/2014 |
| WO | WO2014/187836 | A1 | 11/2014 |

* cited by examiner

DISHWASHER APPLIANCE AND FILTER

FIELD

The present subject matter relates generally to dishwasher appliances and one or more filters which may be used in dishwasher appliances.

BACKGROUND

Dishwasher appliances generally include a tub that defines a wash chamber. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber.

Some dishwasher appliances further include a fluid circulation system that is in fluid communication with the spray assemblies for circulating fluid to the spray assemblies. The fluid circulation system generally receives fluid from the wash chamber, filters soil from the fluid, and flows the filtered fluid either to the spray assemblies or to a drain. To facilitate the flow of filtered fluid to the spray assemblies and/or drain, a pump is typically included in the fluid circulation system.

However, in some existing dishwasher appliances, one or more portions of the appliance may become undesirably clogged or impeded, as when debris or particles accumulate on a filter. This clogging may hinder performance of the dishwasher appliance. For instance, additional water may be needed to complete certain wash cycles. Moreover, if debris is not adequately removed, it may be redeposited onto items within the dishwasher appliance (e.g., dishes), undercutting cleaning performance of the appliance.

Accordingly, further developments may be desirable for operating dishwasher appliances. Moreover, it would be advantageous if further developments addressed one or more of the above issues.

BRIEF DESCRIPTION

A dishwasher appliance includes a tub defining a wash chamber with a sump positioned at a bottom of the wash chamber for receiving fluid from the wash chamber. A filtering system is positioned between the wash chamber and an outlet of the sump portion. The filtering system includes a first filter and a second filter. The second filter includes a hollow annular base portion and a filter body extending between the base portion and the first filter. The second filter also includes a plurality of nozzles circumferentially arranged about the hollow annular base portion, each nozzle of the plurality of nozzles in fluid communication with the hollow annular base portion and oriented towards the filter body for cleaning the filter body. An inlet in fluid communication with the hollow annular base portion may also be provided. Additional aspects and advantages of the invention will be set forth in part in the following description, or may be obvious from the description, or may be learned through practice of the invention.

In one aspect of the present disclosure a dishwasher appliance is provided. The dishwasher appliance defines a vertical direction, a lateral direction, and a transverse direction that are mutually perpendicular. The dishwasher appliance may include a tub defining a wash chamber for receipt of articles for washing with a sump positioned at a bottom of the wash chamber for receiving fluid from the wash chamber. The sump includes a sump chamber having a sidewall and a base wall with a filtering system positioned between the wash chamber and the sump chamber for filtering fluid from the wash chamber. The filtering system includes a filter at least partially disposed within the sump chamber. The filter includes a hollow annular base portion and a filter body extending between the base portion and a top portion with a plurality of nozzles circumferentially arranged about the hollow annular base portion of the filter. The plurality of nozzles are in fluid communication with the hollow annular base portion and oriented towards the filter body for cleaning the filter body.

In another aspect of the present disclosure, a filter for a dishwasher appliance is provided. The filter includes a hollow annular base portion and a filter body extending between the base portion and a top portion. The filter also includes a plurality of nozzles circumferentially arranged about the hollow annular base portion, each nozzle of the plurality of nozzles in fluid communication with the hollow annular base portion and oriented towards the filter body for cleaning the filter body. An inlet in fluid communication with the hollow annular base portion may also be provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
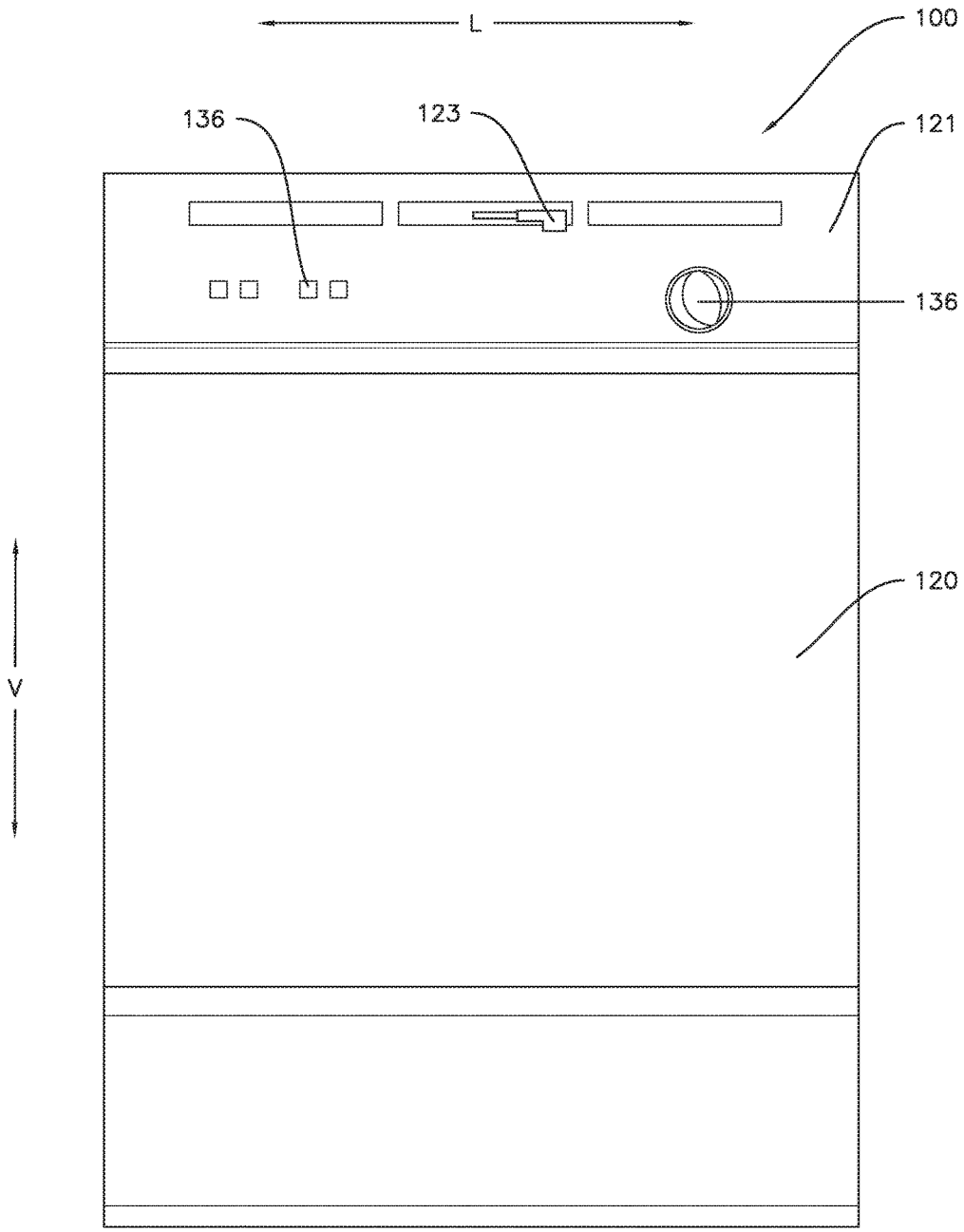
FIG. 1 provides a front view of a dishwasher appliance which may include embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
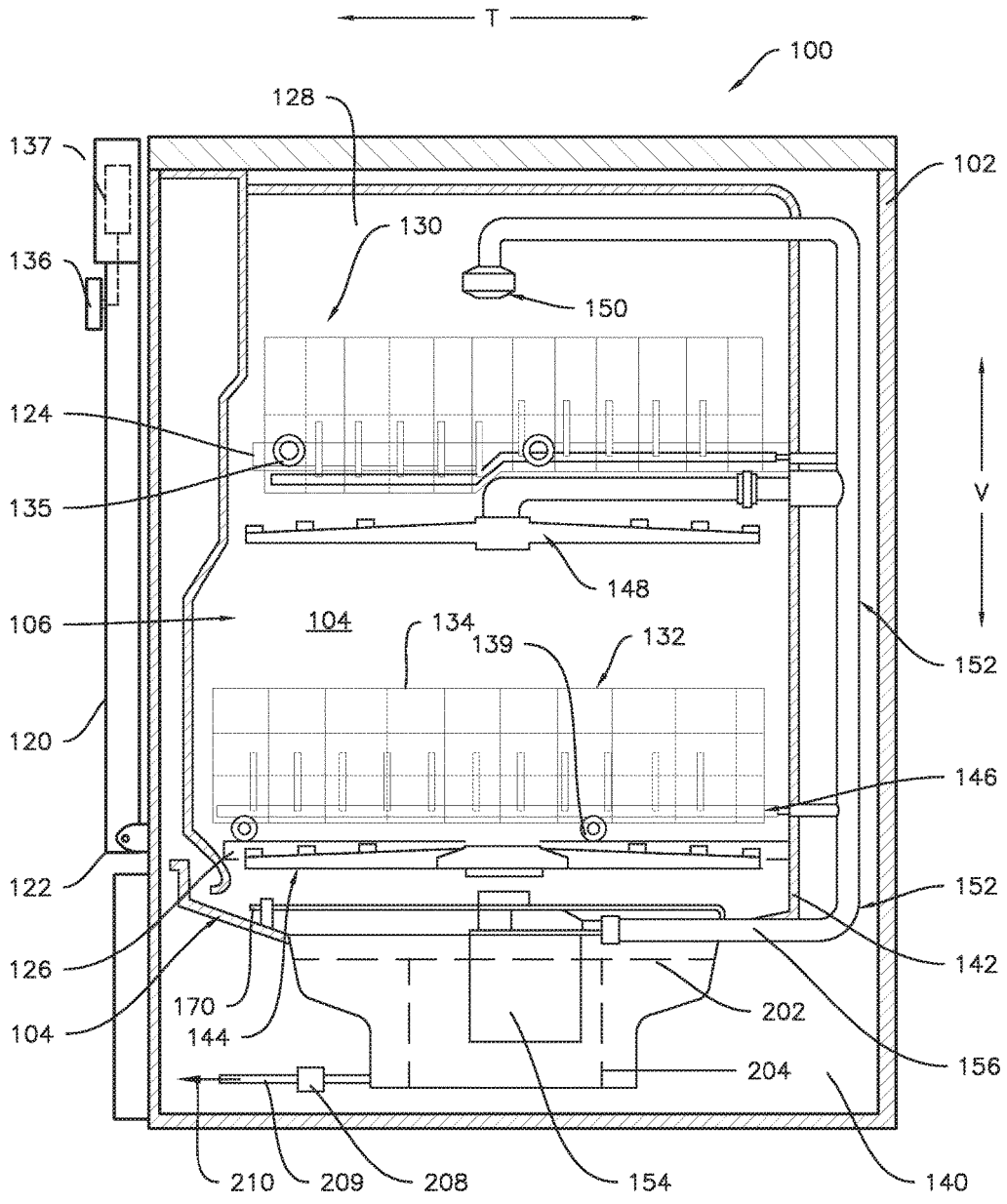
FIG. 2 provides a section view of the dishwasher appliance of FIG. 1.

FIGS. 1 and 2 depict an exemplary domestic dishwasher appliance 100 that may be configured in accordance with aspects of the present disclosure. In the exemplary embodiment of FIGS. 1 and 2, the dishwasher appliance 100 defines a vertical direction V, a lateral direction L, and a transverse direction T. The vertical direction V, lateral direction L, and the transverse direction T are mutually perpendicular. In some embodiments, the dishwasher appliance may include a cabinet 102. As illustrated in FIG. 2, the dishwasher appliance 100 includes a tub 104 therein that defines a wash chamber 106, the wash chamber may receive articles, e.g., dishes, for washing. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 123 is used to lock and unlock door 120 for access to wash chamber 106.

Upper and lower guide rails 124, 126 are mounted on tub side walls 128 and accommodate roller-equipped rack assemblies 130 and 132. In optional embodiments, each of the rack assemblies 130, 132 is fabricated into lattice structures including a plurality of elongated members 134 (for clarity of illustration, not all elongated members forming assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The lower and mid-level spray-arm assemblies 144, 148 and the upper spray assembly 150 are part of a fluid circulation assembly 152 for circulating a wash fluid, which may include water and/or detergent, in the tub 104. The fluid circulation assembly 152 also includes a recirculation pump 154 positioned in a machinery compartment 140 located below the tub sump portion 142 (i.e., below a bottom wall) of the tub 104, as generally recognized in the art. The recirculation pump 154 receives fluid from sump 142 to provide a flow to assembly 152, or optionally, a switching valve or diverter (not shown) may be used to select flow. A heating element 170 can be used to provide heat during, e.g., a drying cycle.

Each spray-arm assembly 144, 148 includes an arrangement of discharge ports or orifices for directing wash fluid received from the recirculation pump 154 onto dishes or other articles located in rack assemblies 130 and 132. The arrangement of the discharge ports in spray-arm assemblies 144, 148 provides a rotational force by virtue of wash fluid flowing through the discharge ports. The resultant rotation of the spray-arm assemblies 144, 148 and the operation of the spray assembly 150 using fluid from the recirculation pump 154 provides coverage of dishes and other dishwasher contents with a washing spray. Other configurations of spray assemblies may be used as well.

In some embodiments, the dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. For certain embodiments, the instructions include a software package configured to operate appliance 100. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 137 may be positioned in a variety of locations throughout dishwasher appliance 100. In the illustrated embodiment, the controller 137 may be located within a control panel area 121 of door 120 as shown in FIGS. 1 and 2. In some such embodiments, input/output ("I/O") signals may be routed between the control system and various operational components of dishwasher appliance 100 along one or more wiring harnesses that may be routed through the bottom 122 of door 120. Optionally, the controller 137 includes a user interface panel/controls 136 through which a user may select various operational features and modes and monitor progress of the dishwasher appliance 100. In exemplary embodiments, the user interface 136 may represent a general purpose I/O ("GPIO") device or functional block. For instance, the user interface 136 may include input components, such as one or more of a variety of electrical, mechanical, or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

In FIG. 2, an exemplary filtering system 200 is illustrated. As shown, in exemplary embodiments, filtering system 200 is located in sump portion 142 and provides filtered fluid to pump 154. Generally, filtering system 200 removes solid particles from the fluid that is recirculated through the wash chamber 106 during operation of dishwasher appliance 100. In exemplary embodiments, filtering system 200 includes both a first filter 202 (also referred to as a "coarse filter") and a second filter 204 (also referred to as a "fine filter").

Figure 3:
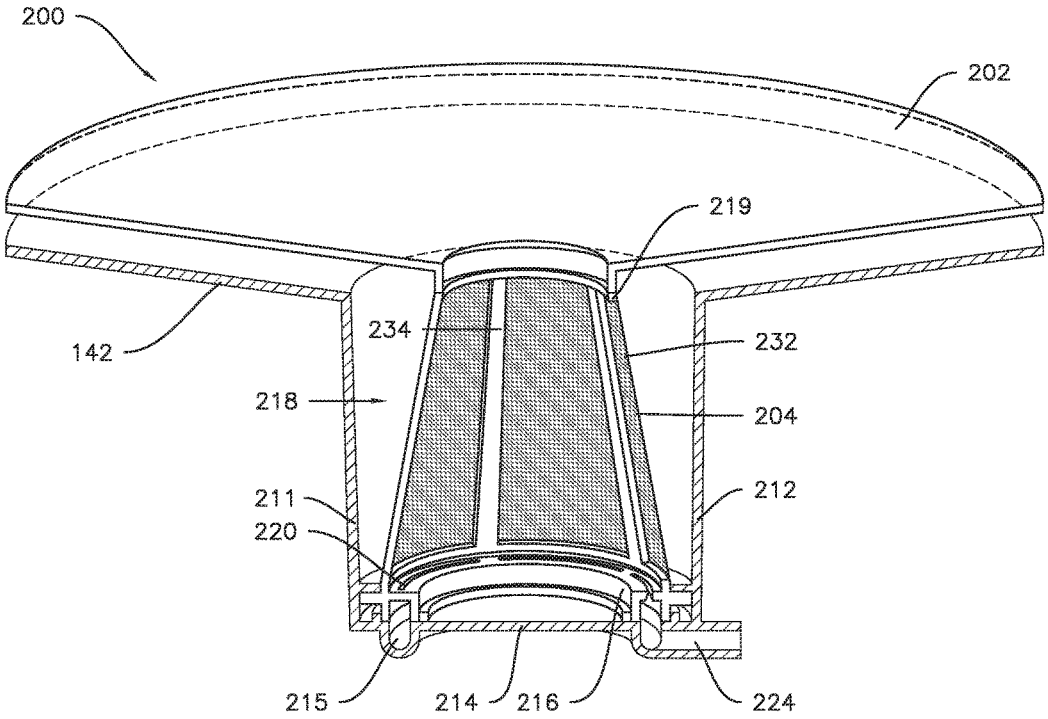
FIG. 3 provides a section view of a filter system according to embodiments of the present disclosure.

The sump portion 142 may be positioned at a bottom of the wash chamber 106 for receiving fluid from the wash chamber 106. Based on the shape of sump portion 142, during certain operations, e.g., washing or cleaning cycles, fluid flows down along a primary flow direction, e.g., in fluid series from the wash chamber 106 to the sump portion 142, whereupon the fluid flows through coarse filter 202 or fine filter 204. In particular embodiments, sump portion 142 may include a sump chamber 211 (FIG. 3). The sump chamber 211 may include a sidewall 212 and a base wall 214. In some embodiments, the filtering system 200 may be positioned between the wash chamber 106 and the sump chamber 211, e.g., along the primary flow direction, for filtering fluid from the wash chamber 106. The filtering system 200, and in particular the fine filter 204 may be at least partially disposed within the sump chamber 211. Accordingly, the primary flow direction includes fluid flow from wash chamber 106 to sump portion 142 and filtering system 200.

After the fluid is filtered by passing through coarse filter 202 or fine filter 204, e.g., downstream along the primary flow direction, the filtered fluid is fed from sump chamber 211 to the recirculation pump 154 for return to the wash chamber 106 by way of fluid circulation assembly 152. After being sprayed onto articles in the dishwasher appliance 100 using one or more of the spray elements 144, 148, and 150, the wash fluid eventually flows to sump portion 142 and is filtered again.

Filtered waste material, such as debris or particles dislodged from items in the dishwasher appliance 100, can be removed from filtering system 200 by a drain pump 208. When drain pump 208 is activated, fluid and/or particles within sump chamber 211 may be directed through exit conduit 209 and drain outlet 210. Accordingly, filtering system 200 acts to remove soil particles from the fluid so as to e.g., protect the recirculation pump 154 and/or the spray assemblies from clogging as the fluid is recirculated during some operations of the dishwasher appliance 100, such as a wash or cleaning cycle of dishwasher appliance 100. The filtering system 200 can also provide a cleaner fluid during the cleaning process, which may result in cleaner articles, e.g., dishes.

FIG. 3 provides a partial illustration of sump portion 142 according to some embodiments. As illustrated, e.g., in FIG. 3, fine filter 204 may be removably mounted in sump portion 142, such as in sump chamber 211. As illustrated in FIG. 3, the fine filter 204 may include a hollow annular base portion 216 and a filter body 218 extending between the base portion 216 and a top portion 219. In some embodiments, the top portion 219 may be positioned adjoining the coarse filter 202. A plurality of nozzles 220 may be circumferentially arranged about the hollow annular base portion 216. The plurality of nozzles 220 are in fluid communication with the hollow annular base portion 216 and the nozzles 220 are oriented towards the filter body 218 for cleaning the filter body 218, as will be described in more detail herein. An inlet 224 in fluid communication with the hollow annular base portion 216 may also be provided.

Figure 4:
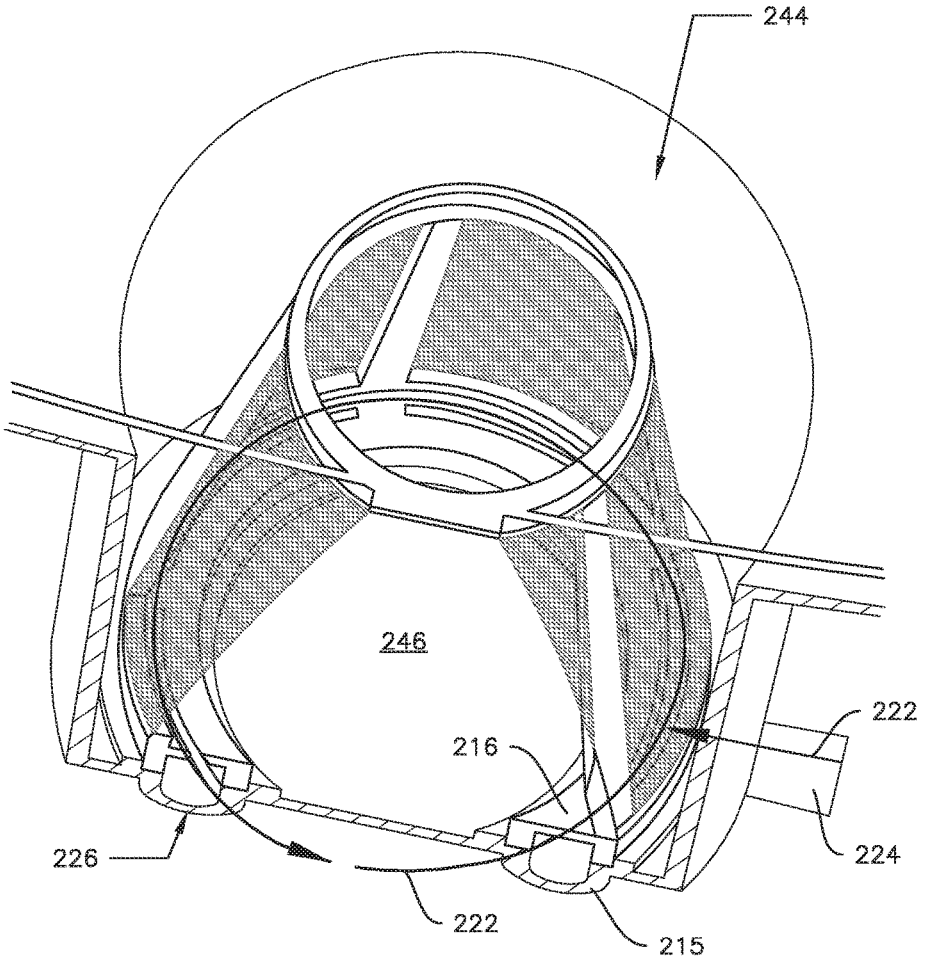
FIG. 4 provides a top, partial section view of a portion of the filter system of FIG. 3.
Figure 5:
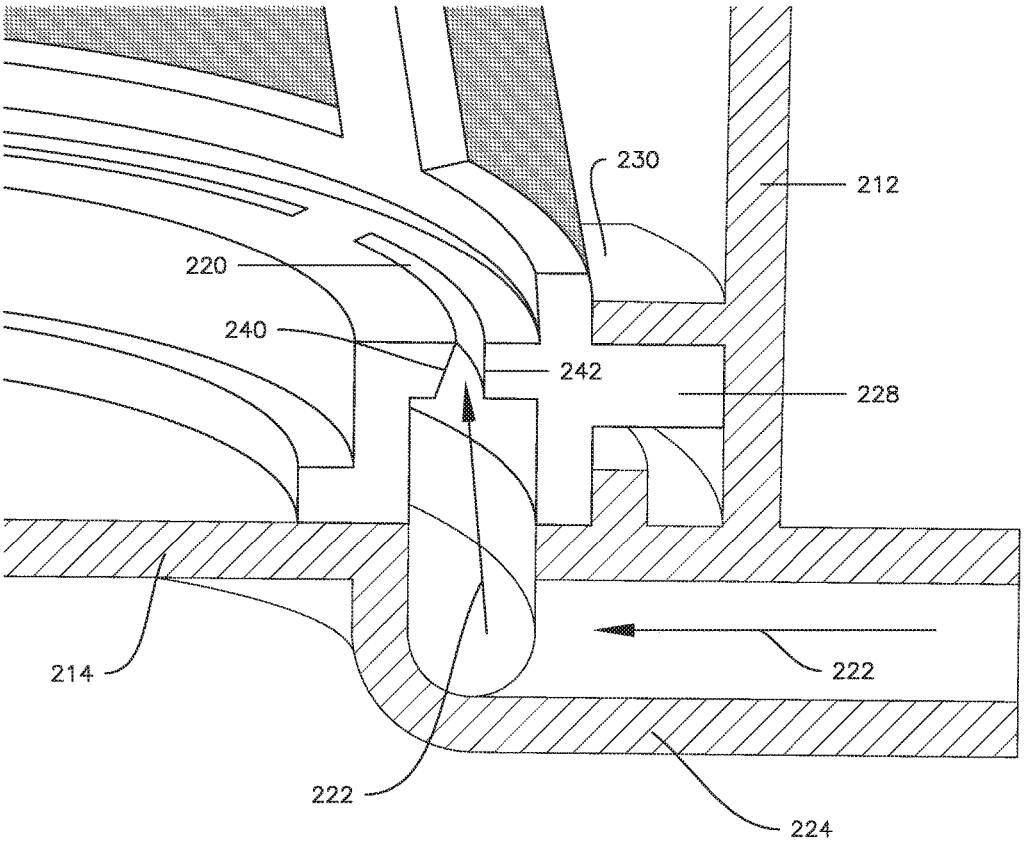
FIG. 5 provides a section view of a portion of the filter system of FIG. 3.

As shown in FIGS. 4 and 5, the hollow annular base portion 216 at least partially defines a liquid-tight pressurizable body 226. The liquid-tight pressurizable body 226 may extend fully around the periphery, e.g., circumference, of the annular base portion 216 to supply fluid to the plurality of nozzles 220. Accordingly, a pressurized fluid 222, e.g., water, may flow from inlet 224 into liquid-tight pressurizable body 226 and to nozzles 220. Pressurized fluid 222 may be provided to inlet 224 from various sources, including fresh water from a dedicated connection to a water supply external to the dishwasher appliance 100 or filtered water from a portion of fluid circulation assembly 152. For example, in some embodiments, the pressurized fluid 222 may be a portion of flow supplied to a spray arm, e.g., lower spray arm assembly 144. As another example, in some embodiments, the pressurized fluid 222 may be provided from a dedicated port in the fluid circulation assembly 152 which supplies fluid solely and directly to the inlet 224.

In some exemplary embodiments, the hollow annular base portion 216 partially defines a liquid-tight pressurizable body 226, with the base wall 214 of sump chamber 211 defining another portion of the liquid-tight pressurizable body 226. In other embodiments, it is also possible for the hollow annular base portion 216 to fully define the liquid-tight pressurizable body 226, and in such embodiments, the inlet 224 may be integrally formed with the hollow annular base portion 216, for example, as illustrated in FIG. 9. Turning again to the particular example embodiments of FIGS. 3 through 8, in these embodiments, the base wall 214 of the sump chamber 211 partially defines the liquid-tight pressurizable body 226. In particular embodiments, the base wall 214 may include a groove 215 which partially defines the liquid-tight pressurizable body 226 and the groove 215 may be integrally formed with the inlet 224. Further, in such embodiments, the hollow annular base portion 216 of the fine filter 204 may be open on a side facing away from the filter body 218, such that the hollow annular base portion 216 of the fine filter 204 and the groove 215 in the base wall 214 may collectively define the liquid-tight pressurizable body 226.

In some exemplary embodiments, e.g., as illustrated in FIG. 5, the hollow annular base portion 216 may be interlockable with the base wall 214 of the sump chamber 211. In some embodiments, the base portion 216 of the fine filter 204 may include tabs 228 that extend radially outward therefrom. Also in such embodiments, the sidewall 212 of sump chamber 211 may have corresponding bosses 230 that extend radially inward from the sidewall and are shaped to interlock with the tabs on the base portion 216 of the fine filter 204, e.g., when the fine filter 204 is rotated. Accordingly in some embodiments, the tabs 228 may be configured to engage with the bosses 230 to interlock the fine filter 204 and the base wall 214 when the fine filter 204 is rotated from an insertion position to a locking position. Thus, in such embodiments the hollow annular base portion 216 of the fine filter 204 and the groove 215 in the base wall 214 may be configured to form the liquid-tight pressurizable body 226 when the hollow annular base portion 216 interlocks with the base wall 214 of the sump chamber 211, e.g., when the fine filter 204 is in the locking position.

Fine filter 204, and in particular the filter body 218 thereof, may include at least one panel 232 formed from one or more fine filter media. Some such embodiments may include filter media, e.g., screen or mesh, having pore or hole sizes in the range of about fifteen thousandths ($^{15}/_{1000}$) of an inch to about forty thousandths ($^{40}/_{1000}$) of an inch in diameter. In some embodiments, the filter body 218 may include a plurality of ribs 234 extending between the hollow annular base portion 216 and the top portion 219. In such embodiments, a plurality of filter panels 232 may be defined between the ribs 234. The filter panels 232 may be distinct bodies of filter media, or may be portions of a single continuous filter media, e.g., screen, extending around the filter body 218. In such embodiments, at least one nozzle 220 of the plurality of nozzles 220 may be positioned proximate to each of the filter panels 232.

As described above, the fine filter 204 is positioned downstream of the wash chamber 106, with respect to the primary flow direction. Accordingly, the fine filter 204 may define an unfiltered volume 244 and a filtered volume 246 within the sump chamber 211. That is, the unfiltered volume 244 may be the portion of sump chamber 211 upstream of the fine filter 204 with respect to the primary flow direction and the filtered volume 246 may be the portion of sump chamber 211 downstream of the fine filter 204 with respect to the primary flow direction. Further, it is understood that the unfiltered volume 244 is unfiltered relative to the fine filter 204. In some embodiments, the plurality of nozzles 220 may be configured to back-flush the filter panels 232, e.g., the nozzles may be positioned within the filtered volume 246 and configured to direct jets 248 of pressurized water emanating from the nozzles 220 through the filter media panels 232, e.g., back towards the unfiltered volume 242 in the opposite direction of the primary flow direction. In the illustrated embodiments of FIGS. 4 and 8, the primary flow direction is radially inward and the orientation of jets 248 includes a radial component which is radially outward, e.g., in the opposite direction of recirculation pump 154 suction flow. However, it is understood by those of skill in the art that the directions may be reversed, e.g., the primary flow direction within the sump chamber 211 of fluid moved by recirculation pump 154 may be or include radially outward flow, and the back-flush provided by jets 248 from nozzles 220 may be oriented to include a radial component which is radially inward.

Figure 6:
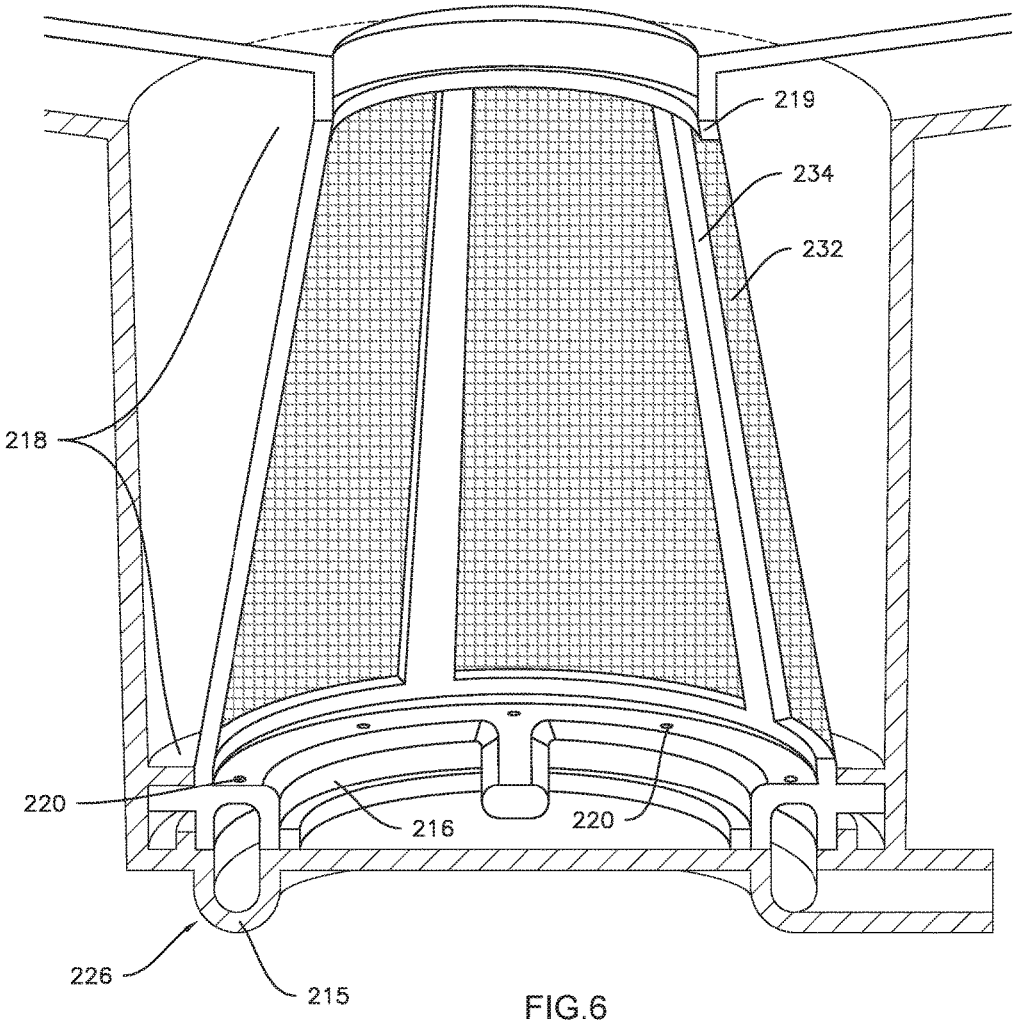
FIG. 6 provides a section view of a filter system according to further embodiments of the present disclosure.

The nozzles 220 may have any suitable shape. As illustrated, e.g., in FIGS. 3 and 5, in some exemplary embodiments, the nozzles 220 may have an elongated shape in a circumferential direction, such as slots, in order to provide a fan jet covering a relatively wide area of each respective panel 232 as compared to pin jets as in FIG. 6. In other exemplary embodiments, e.g., as illustrated in FIG. 6, the nozzles 220 may have a more limited circumferential extent, e.g., the nozzles 220 may have rounded, e.g., circular outlets 238 (FIG. 8), in order to provide a pin jet having a relatively higher pressure as compared to fan jets as in, e.g., FIG. 5. As used herein, "circumferential" refers to a direction extending around the axial centerline of the fine filter 204, e.g., along or parallel to a circumference of the annular base portion 216.

Figure 7:
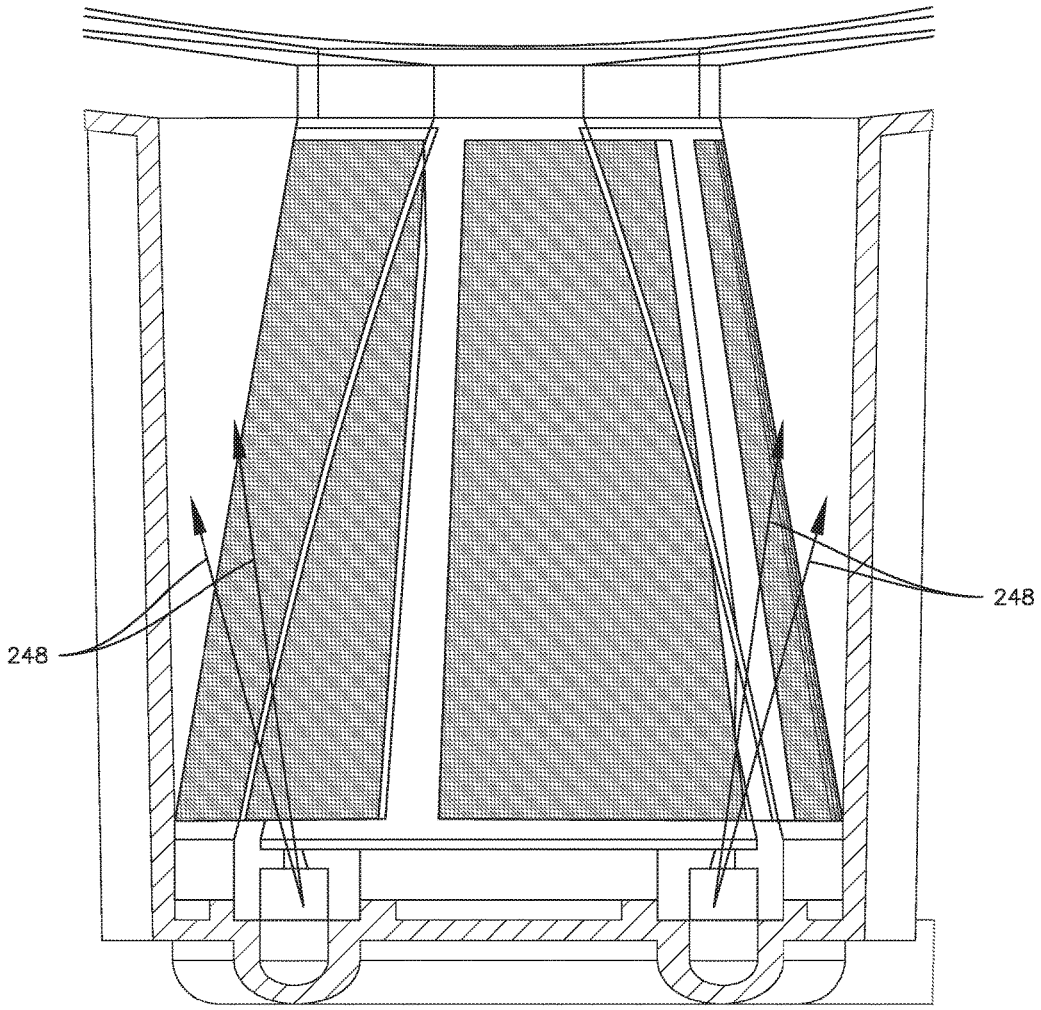
FIG. 7 provides a section view of a filter according to further embodiments of the present disclosure.
Figure 8:
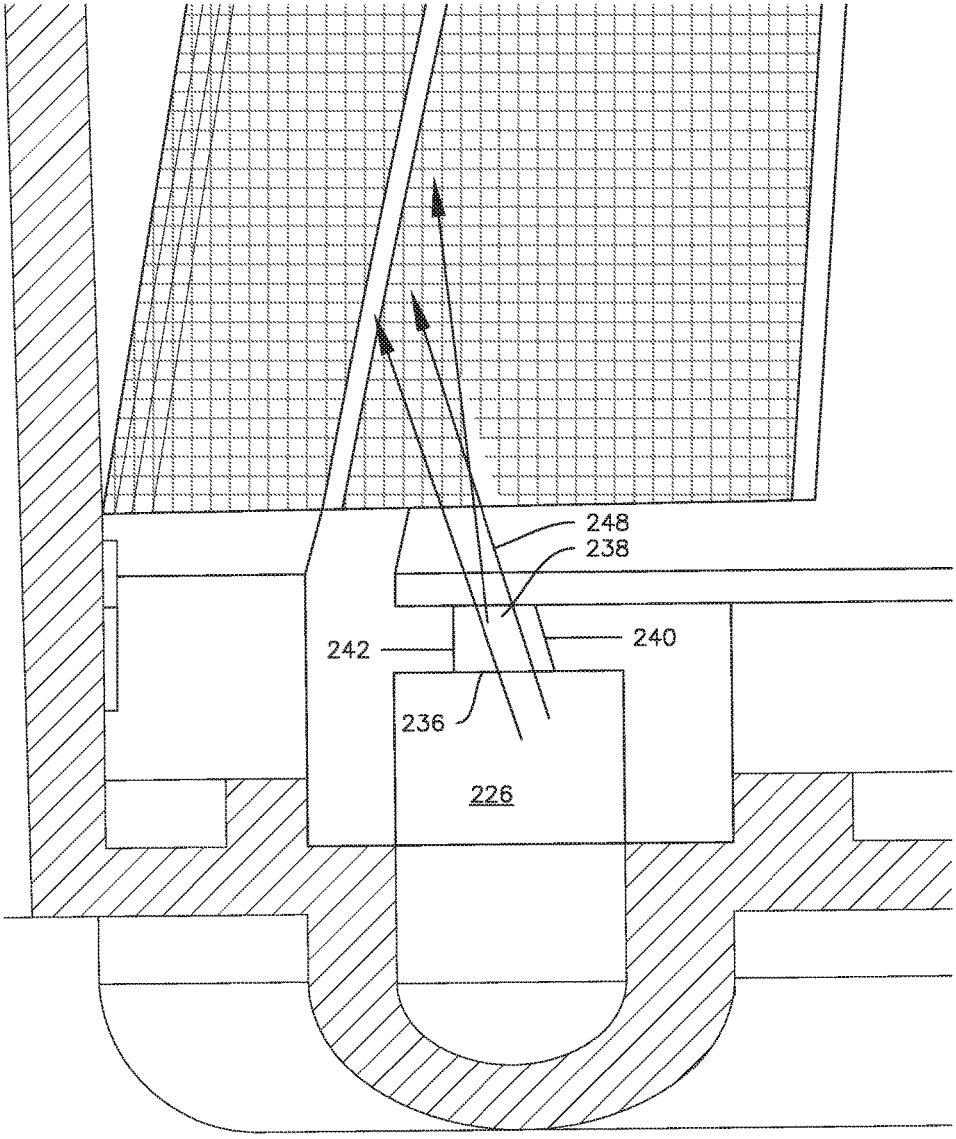
FIG. 8 provides a section view of a portion of the filter system of FIG. 7.
Figure 9:
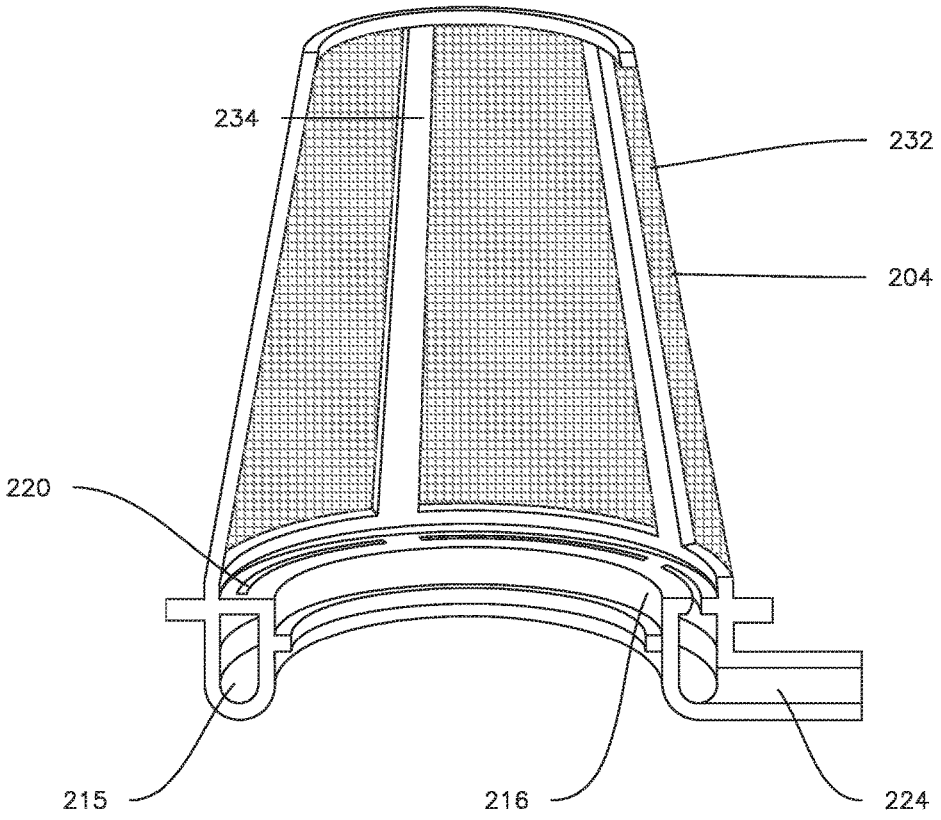
FIG. 9 provides a partial section view of a filter system according to further embodiments of the present disclosure.

In some exemplary embodiments, e.g., as shown in FIGS. 7 and 8, each nozzle 220 of the plurality of nozzles 220 may be configured to direct jets 248 emanating therefrom along a respective direction that is oblique to the vertical direction. Such configuration of the nozzles 220 may provide jets 248 which impart a partially shear force and partially axial force on the panels 232, which may advantageously facilitate particulate removal. Notably, the cross-sectional shape of nozzles 220 illustrated in FIGS. 7 and 8 may be combined with any suitable shape of the nozzles 220 in the circumferential direction, e.g., the elongated shape of FIG. 5 or the rounded shape of FIG. 6. In various embodiments, each nozzle 220 may extend between an inlet 236 and an outlet 238 generally along the vertical direction. Further, each nozzle 220 may include an inner side 240 and an outer side 242. The inner side 240 and outer side 242 may be spaced apart along a radial direction, e.g., with respect to a radius of the fine filter 204, and in particular a radius of the annular base portion 216. In some embodiments, the inner side 240 and the outer side 242 may be opposite sides of a continuous wall, e.g., the nozzle 220 may be configured as a frustum of an oblique cone with circular or rounded inlet 236 and outlet 238. In other embodiments, the inner side 240 and the outer side 242 may be opposing walls of an elongated nozzle 220, e.g., as in FIG. 5. Turning again to FIGS. 7 and 8, the outer side 242 may be oriented substantially parallel to the vertical direction. As used herein, "substantially parallel" includes forming an angle of five degrees or less. The inner side 240 may be oblique to the vertical direction. In some exemplary embodiments, the taper or angle with respect to the vertical direction of the inner wall 240 of each nozzle 220 may be generally opposing the taper of the filter panels 232. For example, as may be seen in FIGS. 5 and 8, moving up along the vertical direction, e.g., generally from base wall 214 of sump chamber 211 towards the wash chamber 106, the inner side 240 of each nozzle 220 may be angled radially outward and the filter panels 232 of the filter body 218 may be angled radially inward.

Figure 10:
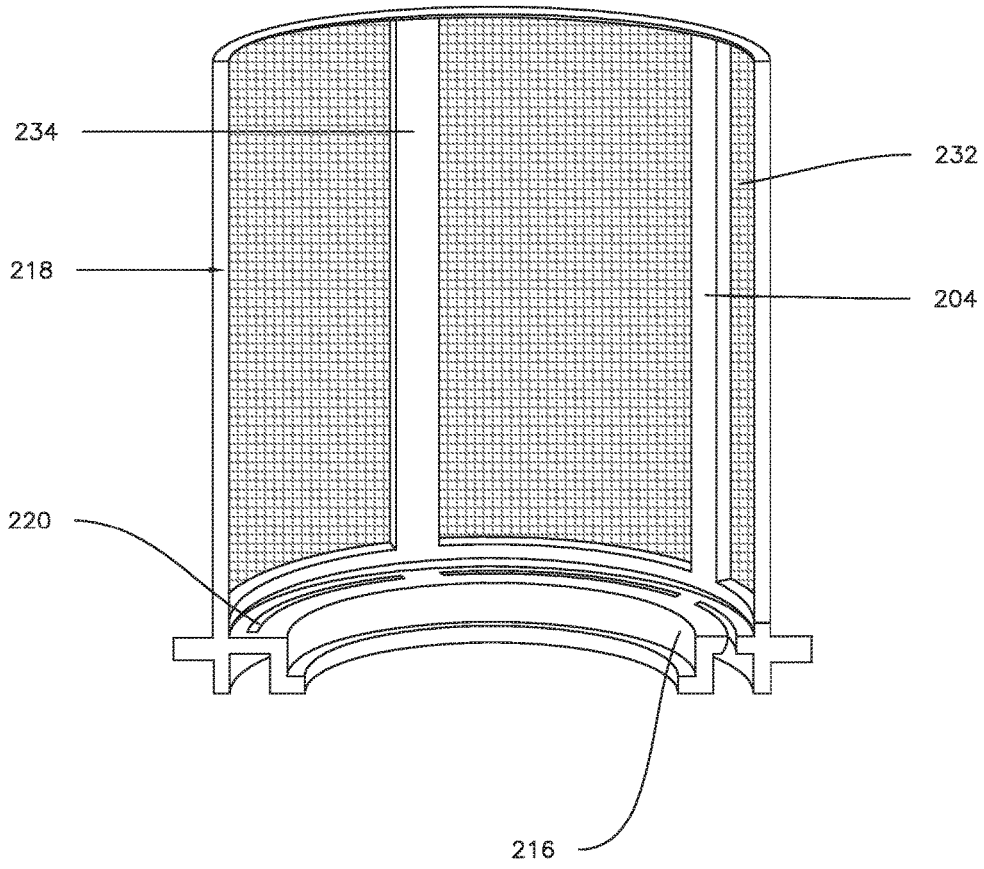
FIG. 10 provides a partial section view of a filter system according to further embodiments of the present disclosure.

The filter body 218 may include a variety of forms, including frustoconical, as in the illustrated exemplary embodiments of FIGS. 3-8, or other shapes wherein the filter body decreases in diameter from the hollow annular base portion to the top portion, as well as cylindrical, as illustrated for example in FIG. 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction that are mutually perpendicular, the dishwasher comprising:

a tub defining a wash chamber for receipt of articles for washing;

a sump positioned at a bottom of the wash chamber for receiving fluid from the wash chamber, the sump comprising a sump chamber having a sidewall and a base wall;

a filtering system positioned between the wash chamber and the sump chamber for filtering fluid from the wash chamber, the filtering system comprising a filter at least partially disposed within the sump chamber, the filter comprising a hollow annular base portion interlockable with the base wall of the sump chamber and a filter body extending between the base portion and a top portion;

a plurality of nozzles circumferentially arranged about the hollow annular base portion of the filter, the plurality of nozzles in fluid communication with the hollow annular base portion and oriented towards the filter body for cleaning the filter body; and an inlet in fluid communication with the hollow annular base portion;

wherein the base wall of the sump chamber comprises a groove, the groove integrally formed with the inlet, and the hollow annular base portion of the filter is open on a side facing away from the filter body, the hollow annular base portion of the filter and the groove in the base wall configured to form a liquid-tight pressurizable body when the hollow annular base portion interlocks with the base wall of the sump chamber.

2. The dishwasher appliance of claim 1, further comprising a plurality of radial tabs extending outwardly from the hollow annular base portion and a plurality of radial bosses extending inwardly from the sidewall of the sump chamber, the tabs engageable with the bosses to interlock the filter and the base wall when the filter is rotated from an insertion position to a locking position.

3. The dishwasher appliance of claim 1, wherein the filter defines a filtered volume and an unfiltered volume within the sump chamber, the plurality of nozzles positioned within the filtered volume.

4. The dishwasher appliance of claim 1, wherein the filter body is cylindrical.

5. The dishwasher appliance of claim 1, wherein the filter body is frustoconical.

6. The dishwasher appliance of claim 1, wherein the filter body decreases in diameter from the hollow annular base portion to the top portion.

7. The dishwasher appliance of claim 1, wherein each nozzle of the plurality of nozzles is configured to direct jets emanating therefrom along a respective direction that is oblique to the vertical direction.

8. The dishwasher appliance of claim 1, wherein the filter body comprises a plurality of ribs extending between the hollow annular base portion and the top portion, a plurality of filter panels defined between the ribs, and wherein at least one nozzle of the plurality of nozzles is positioned proximate to each of the filter panels.

9. A filter for a dishwasher appliance, the filter comprising:

a hollow annular base portion interlockable with a base wall of a sump chamber within the dishwasher appliance;

a filter body extending between the base portion and a top portion; and a plurality of nozzles circumferentially arranged about the hollow annular base portion, each nozzle of the plurality of nozzles in fluid communication with the hollow annular base portion and oriented towards the filter body for cleaning the filter body;

wherein the hollow annular base portion of the filter is open on a side facing away from the filter body, and the hollow annular base portion of the filter is configured to form a liquid-tight pressurizable body when the hollow annular base portion interlocks with the base wall of the sump chamber.

10. The filter of claim 9, further comprising a plurality of radial tabs extending outwardly from the hollow annular base portion and engageable with a sidewall of the sump chamber to interlock the filter and the base wall when the filter is rotated from an insertion position to a locking position.

11. The filter of claim 9, wherein the filter defines a filtered volume and an unfiltered volume within the sump chamber, the plurality of nozzles positioned within the filtered volume.

12. The filter of claim 9, wherein the filter body is cylindrical.

13. The filter of claim 9, wherein the filter body is frustoconical.

14. The filter of claim 9, wherein the filter body decreases in diameter from the hollow annular base portion to the top portion.

15. The filter of claim 9, wherein each nozzle of the plurality of nozzles is configured to direct jets emanating therefrom along a respective direction that is oblique to the vertical direction.

16. The filter of claim 9, wherein the filter body comprises a plurality of ribs extending from the hollow annular base portion and a plurality of filter panels defined between the ribs, and wherein at least one nozzle of the plurality of nozzles is positioned proximate to each of the filter panels.

* * * * *